United States Patent [19]

Nishimura

[11] 4,438,905

[45] Mar. 27, 1984

[54] DEVICE FOR MOUNTING AND DISMOUNTING CHAIN BLOCKS

[75] Inventor: Koji Nishimura, Rittocho, Japan

[73] Assignee: Vital Kogyo Kabushiki Kaisha, Osaka, Japan

[21] Appl. No.: 327,034

[22] Filed: Dec. 3, 1981

[51] Int. Cl.[3] ..... B66D 3/00

[52] U.S. Cl. ..... 254/389; 254/409; 294/83 R; 24/230.5 R

[58] Field of Search ..... 254/401–404, 254/409–415, 389; 294/83 R, 84, 85; 414/538, 559, 571; 280/477; 248/328, 332, 163 A; 24/201 HE, 225–227, 230.5 R

[56] References Cited

U.S. PATENT DOCUMENTS

| | | | |
|---|---|---|---|
| 367,443 | 8/1887 | Provan et al. | 294/83 R X |
| 562,156 | 6/1896 | Schwarzkopf | 254/410 X |
| 1,436,608 | 11/1922 | Rodier | 254/401 X |
| 2,345,621 | 4/1944 | Mothershead | 254/410 X |
| 2,393,657 | 1/1946 | Rudnick | 280/477 |
| 2,418,111 | 4/1947 | Dahlander | 294/83 R |
| 3,891,237 | 6/1975 | Allen | 280/477 |
| 4,077,661 | 3/1978 | Inahashi | 294/83 R |

*Primary Examiner*—John M. Jillions

*Attorney, Agent, or Firm*—Holman & Stern

[57] ABSTRACT

A U-shaped suspension ring is pivotally supported on a horizontal pin inserted through a suspension shaft supported by the top plate of a load suspending tripod or by a support member disposed at a high place. In order to lift a chain block to the position of the suspension ring, a rope passed around the hook of the chain block is divided into a hook lifting rope portion extending around the opposite ends of the horizontal pin and tension rope portions to be pulled from the ground. As a result of this arrangement, the hook can be brought into engagement with the suspension ring in such a manner that the opening in the hook of the chain caught by the lifting rope portion remains unchanged in direction with respect to the suspension ring; on the other hand, the suspension ring can be disengaged from the hook by an operation on the tension rope portions, which operation causes the guide between the arm portions of the suspension ring to change the angle of the suspension ring around the axis of the horizontal pin.

9 Claims, 5 Drawing Figures

DEVICE FOR MOUNTING AND DISMOUNTING CHAIN BLOCKS

BACKGROUND OF THE INVENTION

1. Field of the Invention

The present invention relates to an improved device for mounting and dismounting a chain block to and from a suspension ring, said device being designed so that the hook of a chain block can be mounted and dismounted to and from a suspension ring held at a high place as by a load suspending tripod or a suspension ring connected to a support member at a high place inside or outside a building, easily, safely and positively by an operation from the ground.

2. Description of the Prior Art

For mounting and dismounting a chain block to and from the head of a load handling tripod, it has heretofore been common practice to tie one end of a single rope to the linking hook (hereinafter referred to simply as hook) of the chain block while passing the other end of the rope around a horizontal pin which connects a suspension ring to the lower surface of the head of the tripod, and to pull the other end of the rope downwardly to pull up the chain block so as to engage the hook of said chain block with said suspension ring.

With this method, however, since a single rope is used for pulling up, the twist in the rope affects the lifting operation such that the opening in the hook of the chain block does not always face to the suspension ring. Therefore, it is necessary that the chain block lifted to the high place be manually changed in direction to adjust the direction of the opening in the hook. This operation is difficult and entails danger particularly where the suspension ring is located at a high place which is far above the height of a man; thus, a joint operation of two or more persons is required. For dismounting, the rope is quickly and strongly pulled to cause quick ascent of the hook, with the lower edge of the opening in the hook outwardly kicking the suspension ring, the rope being then slackened by making use of an instant which precedes the restoration of the suspension ring to its original position, thereby disengaging the hook of the chain block from the suspension ring. In cases where the chain block is heavy or said instantaneous disengagement is not smoothly effected, however, the total weight of the chain block and hook is suddenly imposed on the tension rope portions, thus entailing danger on the operator while requiring high physical force and skill on the part of the operator. Further, since a violent tension is often applied to the rope in cases where a heavy chain block is pulled up or down by the rope tied at one end thereof to the hook of said chain block, the knot in the rope sometimes loosens, possibly leading to a free fall of the chain block.

BRIEF SUMMARY OF THE INVENTION

An object of the present invention is to provide a chain block mounting and dismounting construction which eliminates the drawbacks described above and which makes it possible for a single operator to perform the mounting and dismounting operation easily, simply and safely without having to exert a violent force.

BRIEF DESCRIPTION OF THE DRAWINGS

Embodiments of the invention will now be described. In FIGS. 1 through 4, a suspension member 4 is suspended from a top plate 3 which is placed on leg head members 2 connected to the upper end of a tripod 1 by fixtures 11 and which interconnects said leg head members 2 by bolts 12 and nuts 13. A horizontal pin 5 is inserted through the lower portion of said suspension member 4. Suspended from the opposite end extensions of the horizontal pin 5 is a U-shaped suspension ring 6 having support portions **6*a* pivotally mounted on the opposite end portions of the horizontal pin 5**.

Figure 1:
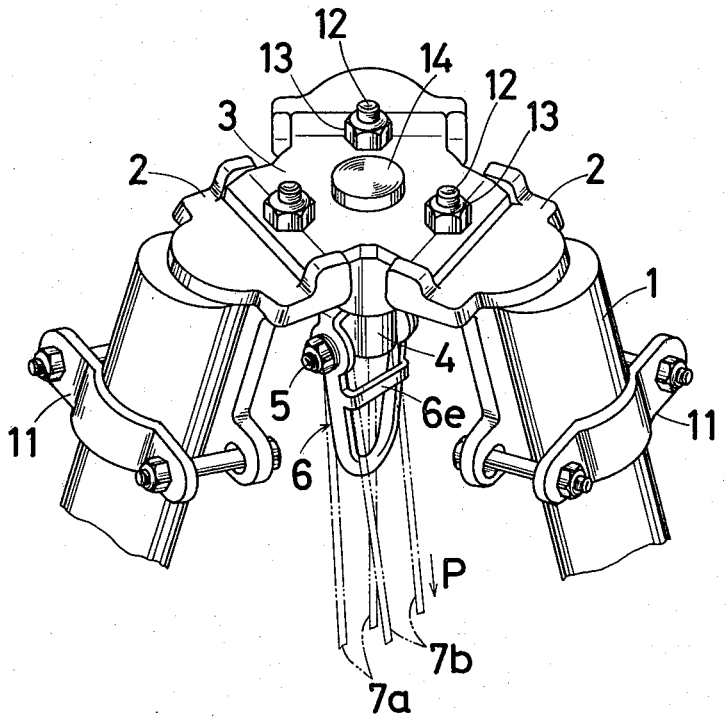
FIG. 1 is a perspective view showing the head portion of a tripod with an embodiment of the present invention mounted thereon.
Figure 2:
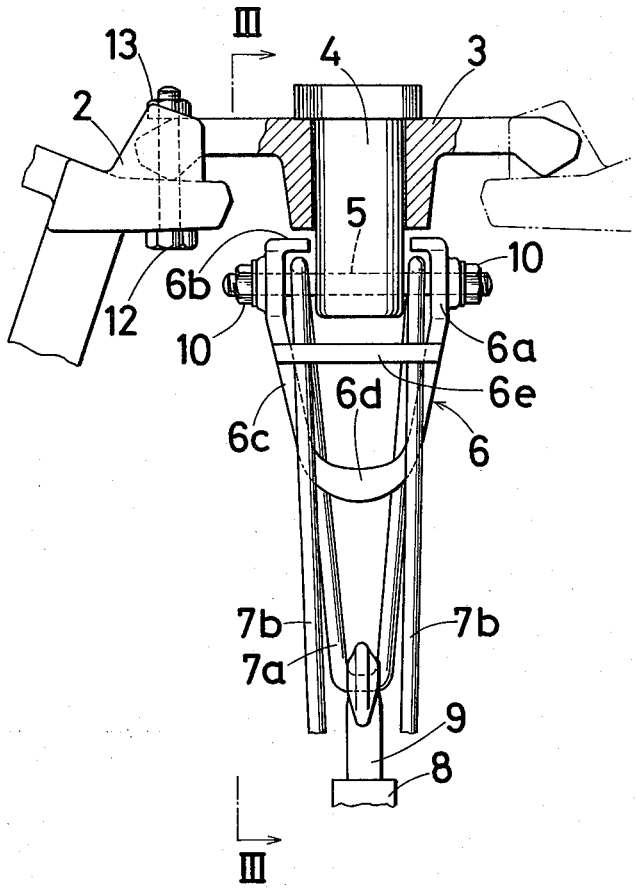
FIG. 2 is a front view of the device.

The upper ends of the opposed support portions **6*a* of the suspension ring 6 are bent at right angles in opposed relation to each other, forming rope slip-off preventive elements 6*b*. In use, a rope 7 is installed on said suspension member 4 such that it extends on both sides of said suspension member and through a space defined by said rope slip-off preventive elements 6*b* and support portions 6*a* while passing around said horizontal pin 5. One region of the rope 7 forms a continuous lifting portion 7*a* with a turn portion caught by the hook 9 of a chain block 8. The other region of the rope 7 is annularly knotted together or forms tension rope portions 7*b* without being knotted together. Nuts 10 are threadedly applied to both ends of the horizontal pin 5** to prevent it from slipping off.

At respective intermediate positions on the opposed arm portions **6*c* of the suspension ring 6, a strip-like guide 6*e* for suspension ring angle change engageable by the respective outer sides of said tension rope portions 7*b* is connected between said arm portions 6*c* in a bridge fashion projecting on the side which faces to the opening in said hook 9**.

The device is used in the following manner.

Figure 4:
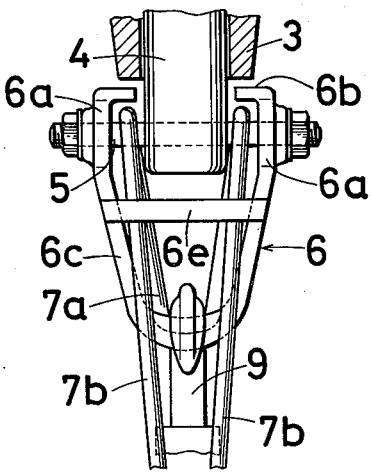
FIG. 4 is a front view showing a hook mounted on a suspension ring.

When it is desired to bring the hook 9 into engagement with the suspension ring 6, the tension rope portions **7*b* are pulled each with substantially the same force in the direction of arrow P. This operation lifts the chain block 8 along with the hook 9 engaged by the lifting rope portion 7*a*. During this lifting operation, since the lifting rope portion 7*a* is pulled while being supported at two places on the horizontal pin 5, which is longer than the diameter of the suspension member 4, the hook 9 is held in such an attitude that its opening correctly faces to the suspension ring 6. In this state, continuing to pull up the hook 9 causes the hook top 9*a* of the hook 9 to push the suspension ring 6 obliquely around the axis of the horizontal pin 5 until the suspension ring is tilted to extend in the direction of the hook tip 9*b* along the outer edge of said hook top. Further pulling the tension rope portions 9*b* to lift the hook 9 disengages the suspension ring 6 from the hook tip 9*b* and allows the suspension ring to turn around the axis of the horizontal pin under its own weight back toward the opening in the hook 9. Finally, the tension rope portions are slightly slackened to allow the hook 9 to engage the suspension ring 6, establishing the perfect linkage state shown in FIG. 4. During this series of operations, the range of pulling direction of the tension rope portions 7***b* is preferably such that the rope does not at all contact the suspension ring direction change strip-like guide 6*e* of the suspension ring 6 or even if it contacts, it does so lightly.

Figure 3:
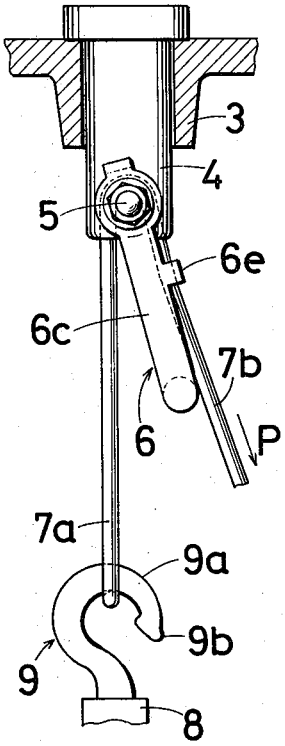
FIG. 3 is a side view taken as indicated by the line III—III of FIG. 2.

When it is desired to remove the hook from the suspension ring 6, as shown in FIG. 3, the pulling direction of the tension rope portions 7*b* is adjusted such that when the hook 9 is not linked to the suspension ring 6, the strip-like guide 6*e* is urged by the tension rope portions 7*b* to move upwardly until the drooping portion 6*d* of the suspension ring lies off the path of movement of the hook 9. That is, an increased angle of the suspension ring 6 with the vertical is adopted and the suspension ring 6 is further lifted by pulling the tension rope portions 7*b*, whereupon the engagement between the suspension ring 6 and the hook 9 is automatically canceled. Thus, if the tension rope portions 7*b* are then gradually slackened, disengagement can be effected easily and safely, enabling the hook 9 to descend.

The suspension member 4 may not necessarily but preferably be rotatable relative to the top plate 3 from the standpoint of easier operation.

Figure 5:
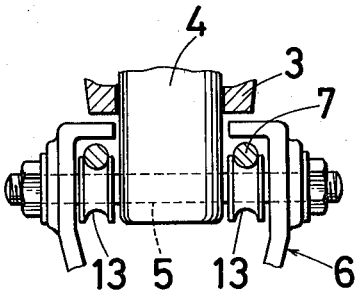
FIG. 5 is a front view showing another embodiment of the invention.

FIG. 5 shows another embodiment of the invention, wherein grooved pulleys 13 are mounted for free rotation on the horizontal pin 5 and the rope 7 is fitted in the grooves of the pulleys. According to this embodiment, friction on the rope 7 is decreased to provide for smooth mounting and dismounting operation.

As has been described so far, according to the present invention, a suspension ring is pivotally supported on a horizontal pin inserted through a suspension member supported by a support member mounted on the head portion of a tripod or disposed at a high place on a building, and a rope is installed to extend on both sides of said suspension member and around said horizontal pin, with the continuous lifting rope portion engaged by the linking hook of a chain block. Therefore, when the chain block is being lifted by pulling the tension rope portions, the hook tip of the hook is maintained correctly opposed to the suspension ring, making it unnecessary to manually adjust its direction. Therefore, the mounting and dismounting of the chain block to and from the suspension ring can be effected by a single operator and, moreover, ground operation is easy and safe.

Further, at respective intermediate places on the opposed arm portions of the suspension ring, a guide for suspension ring angle change is connected between said arm portions in a bridge fashion projecting on the side which faces to the opening in the hook. Therefore, the mounting and dismounting of the chain block can be safely, positively and easily effected by pulling the tension rope portions in the direction which forces the drooping portion of the suspension ring away from the path of upward and downward movement of the hook and then slackening said rope portions.

What is claimed is:

1. A device for mounting and dismounting chain blocks comprising:

a support member located at a high place;

a vertical linear suspension member movably connected to and descending downward from said support member;

a horizontal linear pin inserted through the lower portion of said suspension member so that the ends of said pin protrude outward on opposite sides of said suspension member;

a generally upright U-shaped suspension ring with its two arm portions pivotally mounted on the opposite protruding end portions of said horizontal pin so that each said arm portion is displaced from said linear suspension member a sufficient distance to permit a chain block lifting rope to pass freely therebetween; and a ring guide for changing the angle of the U-shaped suspension ring comprising a bridge bar horizontally connected between the two arm portions of said ring.

2. The device of claim 1 in combination with a single length of chain block lifting rope operatively associated with said device, wherein said rope is looped around the suspension member with respective ends of said rope passing over each of said horizontal pin protruding ends and then hanging downward between the U-shaped suspension ring and the ring guide, so that a chain block hook may be slipped over said loop and lifting and control of the chain block may be provided by manipulation of the two downward hanging ends.

3. The device of claim 1 or 2 wherein pulleys are rotatably mounted on the respective protruding ends of said horizontal pin.

4. The device of claim 3 wherein said pulleys are grooved.

5. The device of claim 1 or 2 wherein the ends of the arms of said U-shaped ring project upward above the points at which they are pivotally mounted on said horizontal pin and then are bent inward toward said suspension member, so as to form respective rope slip-off preventive elements.

6. The device of claim 3 wherein the ends of the arms of said U-shaped ring project upward above the points at which they are pivotally mounted on said horizontal pin and then are bent inward toward said suspension member, so as to form respective rope slip-off preventive elements.

7. The device of claim 1 wherein the support member is a generally horizontal top plate.

8. The device of claim 7 wherein said top plate is mounted on a tripod.

9. The device of claim 8 wherein said vertical linear suspension member is swivel mounted relative to said top plate.

* * * * *